US006745907B2

(12) United States Patent
Kjelgaard

(10) Patent No.: US 6,745,907 B2
(45) Date of Patent: Jun. 8, 2004

(54) CAPPED WRITING TOOL PALETTE

(76) Inventor: Scott Owen Kjelgaard, 3263 Emanuel Church Rd., Lexington, SC (US) 29073

( * ) Notice: Subject to any disclaimer, the term of this patent is extended or adjusted under 35 U.S.C. 154(b) by 0 days.

(21) Appl. No.: 10/207,580

(22) Filed: Jul. 29, 2002

(65) Prior Publication Data

US 2004/0016710 A1 Jan. 29, 2004

(51) Int. Cl.[7] ..... A47F 7/00
(52) U.S. Cl. ..... 211/69.5; 206/1.7; 401/131
(58) Field of Search ..... 211/69.1, 69.5; 206/1.8, 1.7; 401/131

(56) References Cited

U.S. PATENT DOCUMENTS 1,662,077 A * 3/1928 Schwartz
3,167,184 A * 1/1965 Borax
3,188,036 A * 6/1965 Sprung
4,690,271 A * 9/1987 Zak
4,765,494 A 8/1988 Avery
4,782,957 A 11/1988 Kernodle
4,785,947 A * 11/1988 Avery
4,972,947 A 11/1990 McCarthy
5,277,302 A * 1/1994 Seisa ..... 206/1.8
5,420,607 A * 5/1995 Miller et al.
D362,018 S * 9/1995 Damm
6,202,862 B1 * 3/2001 Acquaviva et al. ..... 211/69.5
6,269,960 B1 * 8/2001 Harp ..... 211/69.5
6,457,593 B1 * 10/2002 Hsu ..... 211/69.1
2002/0017540 A1 2/2002 Ewing

* cited by examiner

*Primary Examiner*—Robert W. Gibson, Jr.
(74) *Attorney, Agent, or Firm*—Leatherwood Walker Todd & Mann, P.C.

(57) ABSTRACT

A device for holding a plurality of capped writing tools that facilitates the artistic process of artists that require mobility and quick accessibility to their tools. The device consists of a generally planar base with the shape of an artist's palette. The base has a plurality of holes arrayed on its surface with a twist to lock capability. Inserts that interface with the twist to lock or snap into the holes provide the capability to accept a wide variety of capped writing tools. The inserts have threaded holes or have integrally molded caps to accept the capped writing tools. The inserts can provide additional functionality such as providing holding for cleaning wipes. The device is useable by both right- and left-handed artists. The device allows the artist to carry an assortment of tools chosen by the artist in the arrangement desired by the artist for quick accessibility.

11 Claims, 5 Drawing Sheets

CAPPED WRITING TOOL PALETTE

CROSS REFERENCE TO RELATED APPLICATIONS

Not Applicable

BACKGROUND—FIELD OF INVENTION

This invention relates to a device for holding a plurality of capped-writing tools that facilitates artistic processes that require tool mobility and quick tool accessibility.

BACKGROUND—DESCRIPTION OF PRIOR ART

People have many different learning styles. Some people understand by hearing spoken words, some are more visual. Over the last decade artists have been increasingly used in large group activities to capture words and concepts of the participants. The visual imagery helps those that are visual learners better understand the dialog. The artists typically use capped-writing tools and work on large format surfaces (flip charts, rolls of paper taped to walls, dry-erase surface that can extend along a complete interior wall). The artist's goal in this work is to provide a visual synthesis of a dialog. The artist will use color to help organize and as the dialog progresses the artist will add detail. The process requires the artist to move rapidly along the work surface and to quickly choose and access the correct writing tool. No device currently exists that facilitates the artist interaction with his tools for this type of work. The ideal device would allow:

- the artist to choose tools to be used for the work at hand
- the tools to be organized in the fashion best suited to the artist
- the artist to easily hold the organized tools while working
- the artist to easily choose and access any one of the tools without worrying about loss of the cap
- the device to easily pack with the artist's tools Inventors have attempted to create devices to improve the tool management process.

U.S. Pat. No. 6,269,960 to Harp (Aug. 7, 2001) describes a felt-tip penholder apparatus that holds pens and allows you to roll them into a carrying case. This device does not provide easy access to tools for an artist that is moving along a large work surface.

U.S. Pat. No. 4.972,947 to McCarthy (Nov. 27, 1990) describes a caddy for pens that also allows you to move the pens from location to location but the device only works for caps with shoulders and the ergonomics (shape and weight) do not allow the artist to easily hold the caddy while using the tool.

U.S. Pat. No. 4,765,494 to Avery (Aug. 23, 1988) describes a rolling marker caddy that allows the artist to array his tools for access but the device is large enough that it would be difficult for the artist to quickly move it as he creates the visual.

U.S. patent application 20020017540 (Ewing, Feb. 14, 2002) describes a body mounted marker holder that allows the user to hang markers from his waist. This provides the ability to easily take the tools with you but because the device is waist mounted the ability to easily choose from the tool from number of tools possible would be difficult.

U.S. Pat. No. 4,782,957 to Kernodle (Nov. 8, 1988) describes a support structure for organizing items such as bottles and containers. The flange system described creates a device whose ergonomics would not be suitable for the moving artist.

U.S. Pat. No. 5,277,302 to Selsa (Jan. 11, 1994) describes a device that has the ergonomics required for the artist but does not provide the ability for the artist to choose the capped marker tools they wish to use.

OBJECTS AND ADVANTAGES

Accordingly, it is the general object of the present device to provide a palette for capped-writing tools. It is a more particular objective of the present device to provide a device that allows

- the artist to choose tools to be used for the work at hand
- the tools to be organized in the fashion best suited to the artist
- the artist to easily hold the organized tools while working
- the artist to easily choose and access any one of the tools without worrying about loss of the cap
- the device to easily pack with the artist's tools when not in use Advantages of the device include:

- it works for both right- and left-handed artists
- when not in use by the artist, the device can be temporarily attached to a:
  - metal work surface (i.e., porcelain on steel) by placing magnets on the back of the device
  - non-metal work surfaces by affixing a suction cup with s-hook to the work surface and hanging the device on the s-hook through the thumb/finger hole

SUMMARY

The invention described is a device for holding a plurality of capped writing tools that facilitates the artistic process of artists that require mobility and quick accessibility to their tools. The device consists of a generally planar base with the shape of an artist's palette. The base has a plurality of holes arrayed on its surface with a twist to lock capability. Inserts that interface with the twist to lock or snap into the holes provide the capability to accept a wide variety of capped writing tools. The inserts have threaded holes or have integrally molded caps to accept the capped writing tools. The inserts can provide additional functionality such as providing holding for cleaning wipes.

DRAWING FIGURES

REFERENCE NUMERALS IN DRAWINGS

FIG. 1.

Item 101. Base

Item 102. Twist and lock Insert for one typical shape of cap for a capped-writing tool.

Item 103. Cap that works with item 102

Item 104. Snap-in insert for holding cloth for erasing dry-erase work surface.

Item 105. Twist and lock Insert for another typical shape of cap for a capped-writing tool.

Item 106. Cap that works with item 105.

Item 107. Capped-writing tool body.

FIG. 2.

Item 201. Base

Item 202 and 203. Twist and lock insert for two different capped writing tools.

Item 204. Snap in insert for holding dry-erase claening cloth.

Item 205. Insert with integrally molded cap.

FIG. 3.

Item 301. Base for a single type of capped writing tool.

Items 302–309. Caps that fit holes of item 301.

FIG. 4.

Item 401. Palette that has caps integrally molded into the base.

FIG. 5.

Item 5. Base with shape of stegosaurus for children's palette.

DESCRIPTION OF PREFERRED EMBODIMENT

Figure 1:
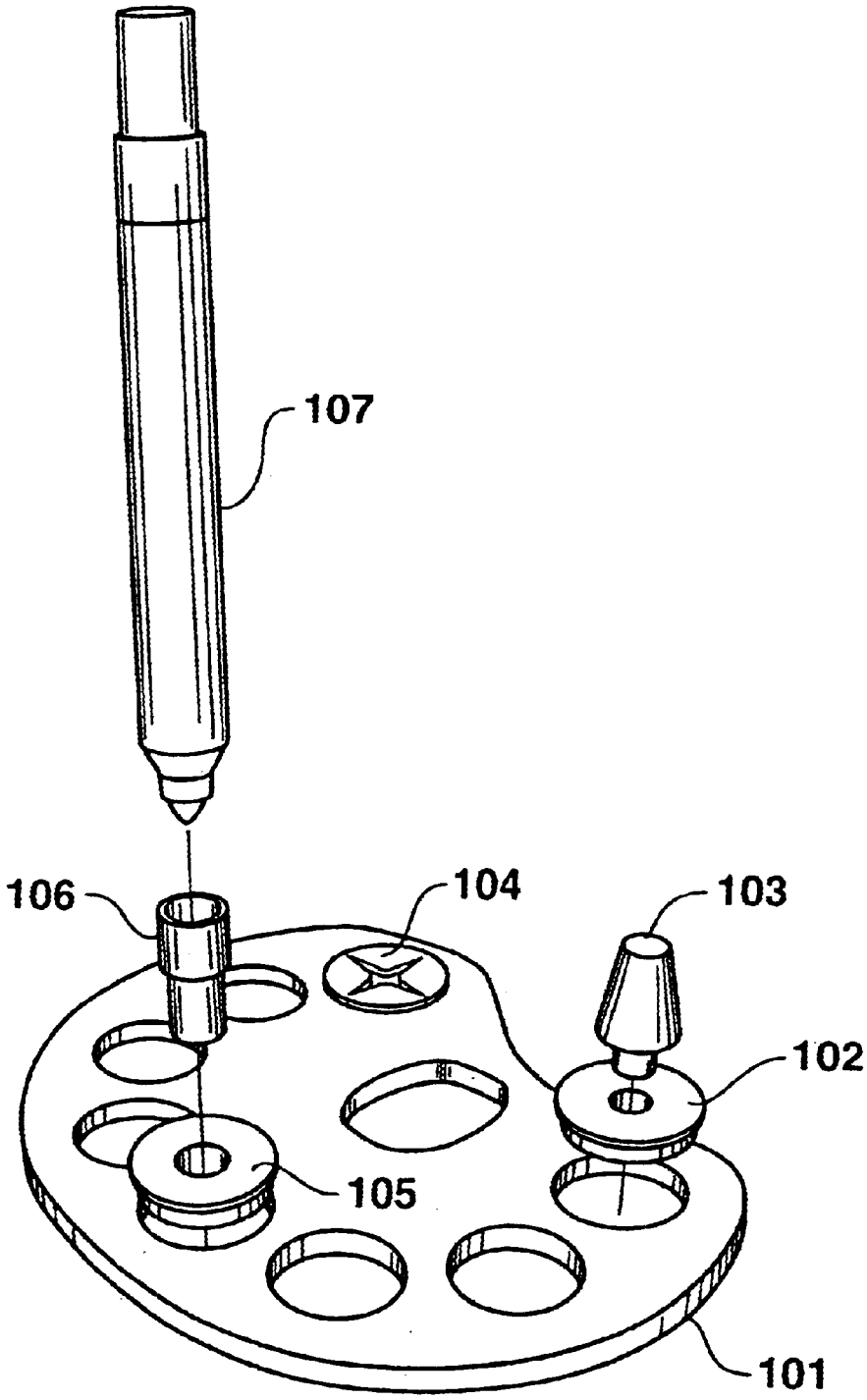
FIG. 1 is a perspective view of one embodiment of the device, which shows the palette, inserts and capped-writing tool caps.

The device consists of a generally planar base (FIG. 1, item 101) that has a plurality of holes compatible with a twist and lock mechanism (i.e. threads). These holes provide a standard size for an insert (items 102 and 105) that is specific to the capped-writing tool to be used. The typical insert, or receptacle, has a threaded hole or aperture, sized so it will hold the writing tool cap (items 103 and 106) without cutting through the cap. The size of the base can be scaled to hold a large number of capped-writing tools. The shape of the base is that of a palette with a hole, or, digit hole, for the thumb to extend through although additional holes can be added for fingers.

Figure 2:
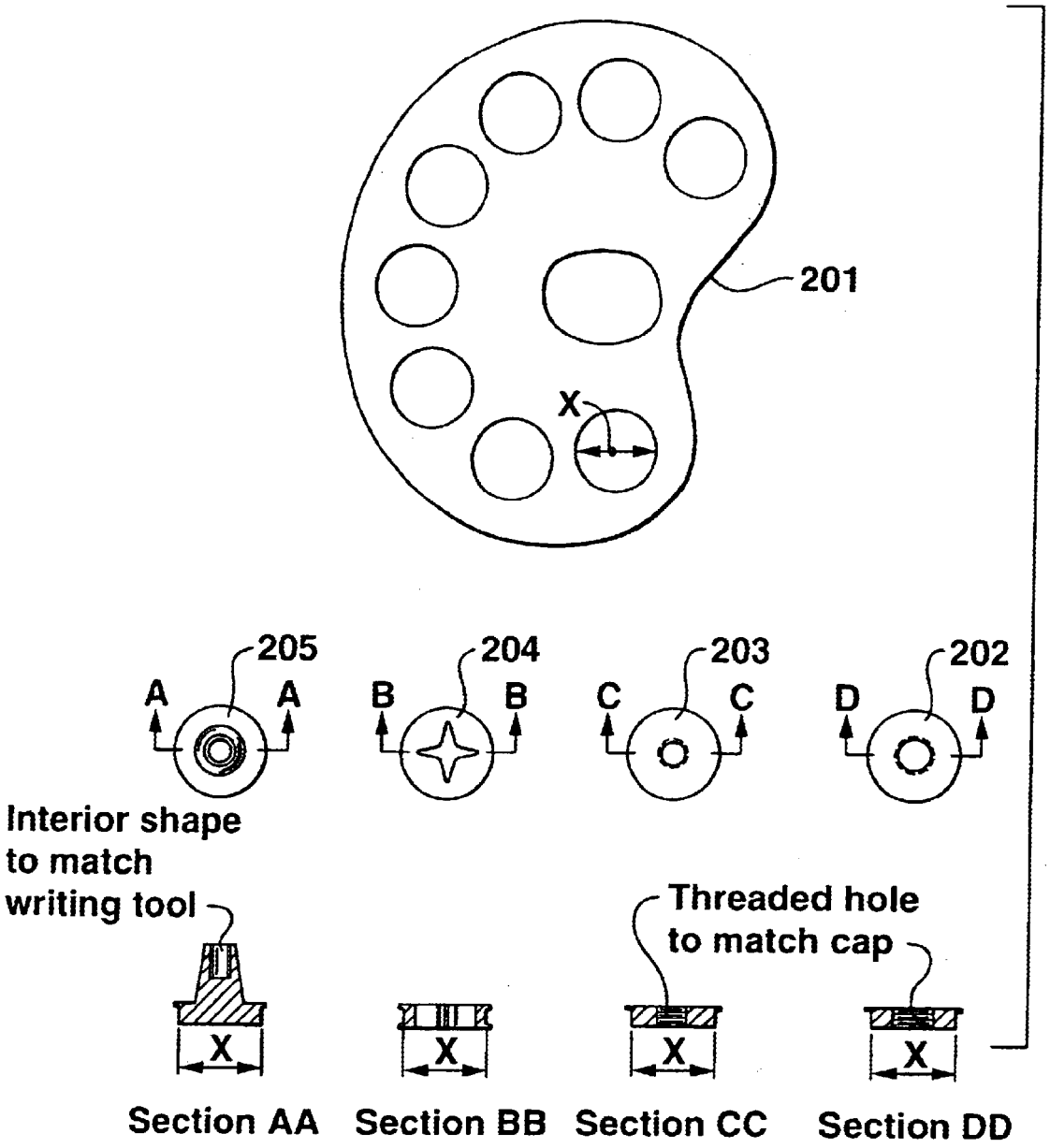
FIG. 2 is a top view of one embodiment of the palette and inserts.

Molded inserts may be required that mate to capped writing tools whose caps do not allow threaded insertion (FIG. 2, item 205). Inserts are not limited to capped-writing tools, item 204 in FIG. 2 shows an insert that is flexible plastic that can be used for holding a wipe for cleaning a dry-erase board. This insert snaps into the base showing an alternative approach for insert installation. Other insert options will become apparent as artists use this device in their work.

If the artist desires to put down the device, there are two options for allowing the artist to keep the device close at hand. If working on a metallic work surface such as porcelain on steel, the artist can affix magnets to the device (the base or specific inserts) to allow the device to hang on the work-surface. For work surfaces that are smooth but non-metallic a simple suction cup with an s-hook can be used. The suction cup is affixed to the work surface and the s-hook holds the device by the thumb hole.

The artist selects from his tool set the capped-writing tools to be used. Based on these, he selects the appropriate inserts and installs them into the device base. Depending on whether the artist is right- or left-handed, the artist will install the inserts into the top or bottom of the device base. The writing tool caps are then screwed into the appropriate inserts in the pattern the artist desires. The writing tool is then inserted into the cap that has been attached to the device base. While drawing, the artist holds the device in his non-drawing hand. To access a writing tool, the artist selects the writing tool, grabs the writing tool body (FIG. 1, item 107) and twists while pulling to remove the writing tool. The cap stays in the device so it is not lost. When the artist completes use of the specific writing tool, he returns the tool to its cap on the device by pushing it back.

DESCRIPTION of ALTERNATIVE EMBODIMENTS

Figure 3:
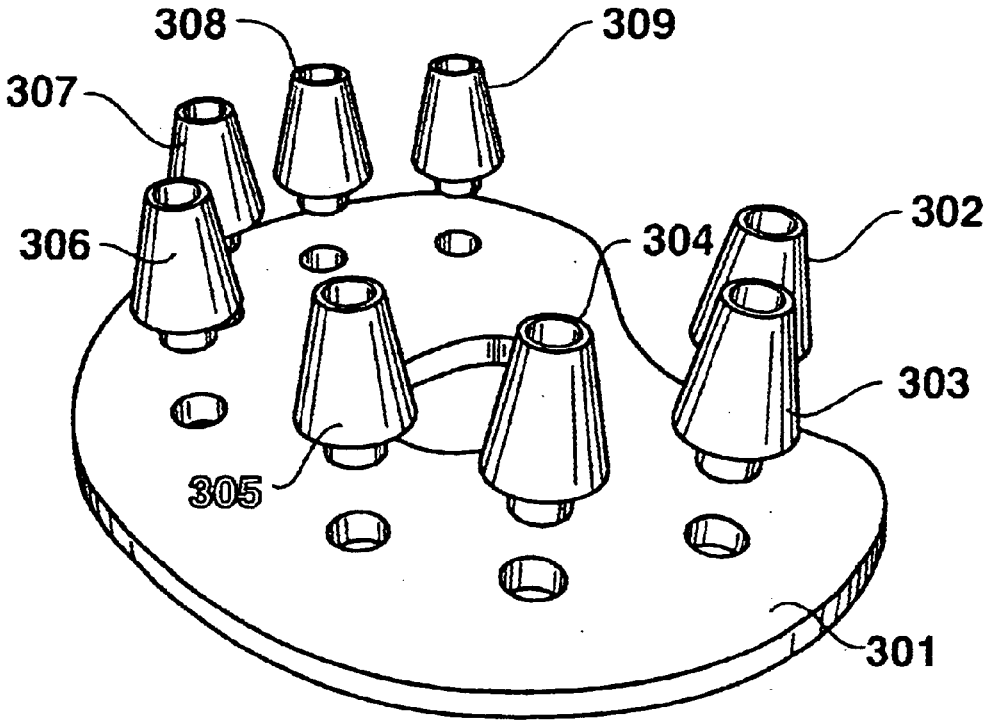
FIG. 3 is a top view of one alternative embodiment, a simplification of the design for one specific capped writing tool.

The device can be simplified if the artist uses only one type of writing tool. The threaded hole, or receptacle, that accepts the writing tool cap that is place in the insert can be made in the base (eliminating the insert; FIG. 3, item 301). This embodiment eliminates the ability of the artist to choose from his complete tool set of different capped writing tools but this embodiment may meet the needs of a large number of users.

Figure 4:
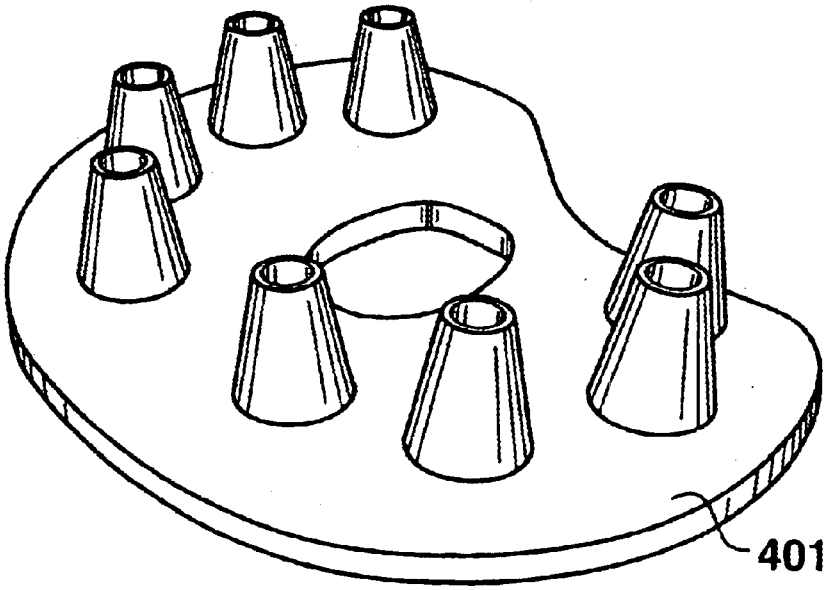
FIG. 4 is a perspective view of one alternative embodiment, a simplification of the design for one specific capped writing tool that requires an integrally molded cap.

Another simplification of the design for a single capped writing tool is the molding of the cap as an integral part of the base (FIG. 4). This embodiment again eliminates the ability of the artist to choose from his complete tool set of different capped writing tools, similar to the previous alternative embodiment.

Figure 5:
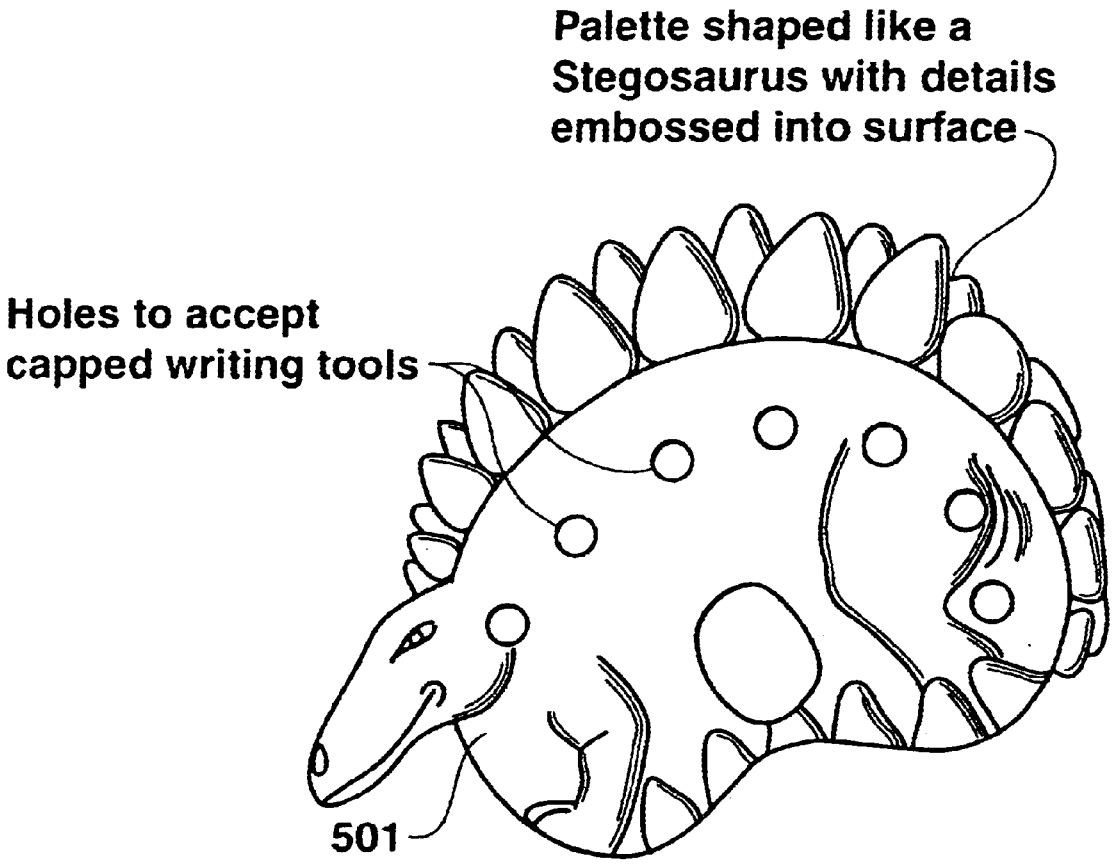
FIG. 5 is a sketch of an alternative embodiment for children's use.
Figure 6:
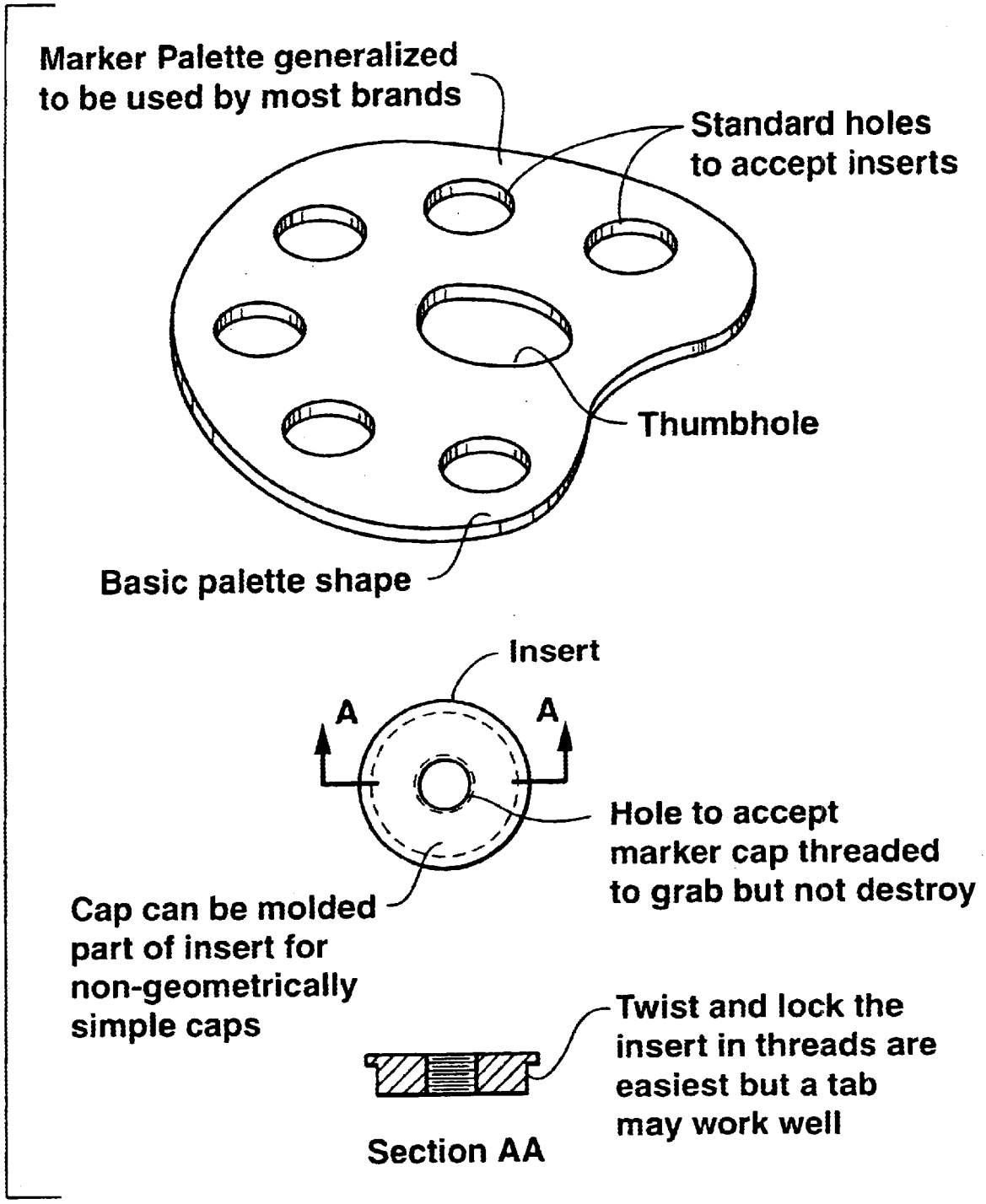
FIG. 6 is a copy of the original concept drawing from the inventor's journal dated Jul. 15, 2001.

Another embodiment of the design is a modification of the shape to one more interesting for children. FIG. 5 shows the alternative embodiment of FIG. 3 applied to a shape resembling a stegosaurus.

Conclusion, Ramifications, and Scope

The device presented provides a simple yet elegant and attractive approach to the needs of the artist that works on large work surfaces with capped writing tools. The device allows the artist to select capped writing tools from his tool set and mount these in an arrangement that meets his needs through the use of inserts. Possible inserts extend beyond capped-writing tools and further increase the functionality of the device. The size and shape of the device provides the artist to easily carry his tools with him and to select and access his tools. The device retains the cap so loss of the cap is prevented. When the artists work is complete, the device can be disassembled into small pieces that can easily pack into the artist's toolbox. The design of the device allows the inserts to be installed from the top or bottom making the device useable for right- and left-handed artists. Temporary storage of the device while in use is illustrated for multiple types of work surfaces using magnets.

The device can be simplified for single capped writing tools by eliminating the inserts or molding the caps into the device base.

While particular embodiments of the invention have been shown and described, it will be obvious to those skilled in the art that changes and modifications may be made without departing from the device in its broadest aspects. Therefore, the aim in the appended claims is to cover all such changes and modifications that fall within the true spirit and scope of the device.

That which is claimed:

1. A device adapted for being carried by the hand of a user for holding a plurality of writing tools having caps, the device comprising:

a generally planar base defining a plurality of receptacles, said receptacles each having an aperture a threaded profile;

said base defining a digit hole adapted for receipt of a digit of the hand of the user; and each of said receptacles being adapted for receipt of the cap of the writing instrument and configured such that upon rotation of the cap in said receptacle in a predetermined direction, the cap becomes threadingly engaged with said threaded profile and thereby selectively locked in said receptacle.

2. The device as defined in claim 1, further comprising said base defining a plurality of base holes and wherein one of said receptacles is received in each of said plurality of base holes.

3. The device as defined in claim 1, further comprising said base defining a plurality of threaded base holes and each of said receptacles having a threaded portion, and wherein said threaded portion of each of said receptacles is threadingly received in each of said plurality of threaded base holes.

4. A device adapted for being carried by the hand of a user for holding a plurality of writing tools having caps, the device comprising:

a generally planar base defining a plurality of base holes, said base holes each having an inner surface defining a twist and lock mechanism;

said base defining a digit hole adapted for receipt of a digit of the hand of the user; and each of said base holes being adapted for receipt of the cap of the writing instrument and configured such that upon rotation of the cap in said base hole in a predetermined direction, the cap becomes threadingly engaged with said twist and lock mechanism and thereby selectively locked in said base hole.

5. The device as defined in claim 4, wherein said twist and lock mechanism is a threaded profile provided on said inner surface of each of said base holes.

6. A device adapted for being carried by the hand of a user, the device comprising:

a generally planar base defining a plurality of base holes, said base holes each defining a threaded profile;

said base defining a digit hole adapted for receipt of a digit of the hand of the user;

a plurality of writing instruments, each of said writing instruments including a removable cap; and each of said base holes being adapted for receipt of said cap and configured such that upon rotation of the cap in said base hole in a predetermined direction, said cap becomes threadingly engaged with said threaded profile and thereby selectively locked in said base hole.

7. A device adapted for being carried by the hand of a user, the device comprising:

a generally planar base defining a plurality of receptacles, said receptacles each having an aperture defining a threaded profile;

said base defining a digit hole adapted for receipt of a digit of the hand of the user;

a plurality of writing instruments, each of said writing instruments including a removable cap; and each of said receptacles being adapted for receipt of said cap of each said writing instrument and configured such that upon rotation of the cap in said receptacle in a predetermined direction, the cap becomes threadingly engaged with said threaded profile and thereby selectively locked in said receptacle.

8. A method of providing a palette of writing instruments, the method comprising:

providing a generally planar base defining: a digit hole adapted for receipt of a digit of the hand of the user; a plurality of base holes; and a plurality of receptacles, said receptacles each having an aperture defining a threaded profile;

providing a plurality of writing instruments, each of said writing instruments including a removable cap;

inserting one of said plurality of receptacles into each of said plurality of base holes; and inserting said cap of at least one of said writing instruments into at least one of said receptacles and rotating said cap in said receptacle in a predetermined direction until the cap becomes threadingly engaged with said threaded profile and thereby selectively locked in said receptacle.

9. A method of providing a palette of writing instruments, comprising:

providing a generally planar base defining a digit hole adapted for receipt of a digit of the hand of the user and a plurality of base holes, said base holes each defining a threaded profile;

providing a plurality of writing instruments, each of said writing instruments including a removable cap; and inserting said cap of at least one of said writing instruments into at least one of said base holes and rotating said cap in said base hole in a predetermined direction until the cap becomes threadingly engaged with said threaded profile and thereby selectively locked in said base hole.

10. A device adapted for being carried by the hand of a user for holding a plurality of writing tools having caps and another object, the device comprising:

a generally planar base defining a plurality of receptacles, said receptacles each having an aperture defining a threaded profile;

said base defining a digit hole adapted for receipt of a digit of the hand of the user;

said base including a receiver having a flexible plastic portion adapted for receipt and retention of the article; and each of said receptacles being adapted for receipt of the cap of the writing instrument and configured such that upon rotation of the cap in said receptacle in a predetermined direction, the cap becomes threadingly engaged with said threaded profile and thereby selectively locked in said receptacle.

11. A device adapted for being carried by the hand of a user for holding a plurality of elongated writing tools having caps with an engagement profile, the device comprising:

a generally planar base defining a plurality of receptacles, said receptacles each having an aperture defining a cooperating profile;

said base defining a digit hole adapted for receipt of a digit of the hand of the user; and each of said receptacles being adapted for receipt of the cap of the writing instrument and configured such that upon insertion of the cap in said receptacle, said cooperating profile cooperates with the engagement profile of the cap to selectively fix the cap against relative rotation with respect to said receptacle.

* * * * *

UNITED STATES PATENT AND TRADEMARK OFFICE

CERTIFICATE OF CORRECTION

PATENT NO. : 6,745,907 B2
DATED : June 8, 2004
INVENTOR(S) : Scott Owen Kjelgaard It is certified that error appears in the above-identified patent and that said Letters Patent is hereby corrected as shown below:

Column 4,
Line 66, after the word "aperture" please insert the word -- defining. --

Signed and Sealed this

Fourteenth Day of September, 2004

JON W. DUDAS
*Director of the United States Patent and Trademark Office*